US005809905A

United States Patent [19]

John et al.

[11] Patent Number: 5,809,905

[45] Date of Patent: Sep. 22, 1998

[54] VERTICAL INTERLOCKING MODULAR PALLET APPARATUS AND METHOD OF CONSTRUCTION

[75] Inventors: Michael John, Boca Raton; Robert V. Daigle, Pompano Beach, both of Fla.

[73] Assignee: Plastic Pallet Production, Inc., Dallas, Tex.

[21] Appl. No.: 796,571

[22] Filed: Feb. 6, 1997

Related U.S. Application Data

[63] Continuation-in-part of Ser. No. 562,507, Nov. 24, 1995, which is a continuation-in-part of Ser. No. 523,639, Sep. 5, 1995.

[51] Int. Cl.[6] ..... B65D 19/00

[52] U.S. Cl. ..... 108/56.1; 108/901; 108/64; 108/57.26; 403/331; 403/327

[58] Field of Search ..... 108/51.11, 53.1, 108/53.3, 56.1, 56.3, 902, 901, 64, 57.26, 57.25, 57.29; 403/331, 334, 340, 327, DIG. 7

[56] References Cited

U.S. PATENT DOCUMENTS

| | | | |
|---|---|---|---|
| 3,857,342 | 12/1974 | Johns | 108/56.1 X |
| 4,051,787 | 10/1977 | Nishitani et al. | 108/901 X |
| 4,694,962 | 9/1987 | Taub | 108/56.1 X |
| 4,955,940 | 9/1990 | Welleman | 108/56.1 |
| 5,483,899 | 1/1996 | Christie | 108/56.3 |

FOREIGN PATENT DOCUMENTS

| | | | |
|---|---|---|---|
| 2362053 | 4/1978 | France | 108/902 |
| 2106234 | 1/1979 | Germany | 108/56.1 |
| 1156430 | 6/1969 | United Kingdom | 108/51.1 |
| 9201607 | 2/1992 | WIPO | 108/56.1 |

*Primary Examiner*—Peter M. Cuomo
*Assistant Examiner*—Janet M. Wilkens
*Attorney, Agent, or Firm*—McHale & Slavin, P.A.

[57] ABSTRACT

An interlocking modular pallet apparatus and method of construction which includes plastic modular platform sections aligned in a two-by-two arrangement with interlocking flanges between the adjoining surfaces of the platform sections, the flanges interlocking in a downward sliding manner. A plurality of leg structures extend down from the lower surface of the platform sections. A center conical support structure with a locking lip or tab is formed by the adjoinment of the platform sections. A band or ring of durable material, e.g. metal, is placed onto the conical structure to draw and lock together, via the locking tab and ring, the adjoining platform sections. A series of upper and lower frictional, rubberized pads are aligned and interlocked through the lattice holes along the perimeter of the pallet lattice.

13 Claims, 7 Drawing Sheets

VERTICAL INTERLOCKING MODULAR PALLET APPARATUS AND METHOD OF CONSTRUCTION

This is a continuation-in-part of application Ser. No. 08/562,507, filed Nov. 24, 1995 which is a continuation-in-part of application Ser. No. 08/523,639, filed Sept. 5, 1995. Application Ser. No. 08/562,507 and application Ser. No. 08/523,639 are currently pending.

FIELD OF INVENTION

This invention is related to pallet construction, and in particular, to a modular pallet construction having interlocking components.

BACKGROUND OF THE INVENTION

The general utility of pallets is well known for its use as a loading platform for storage and movement of products in quantity. Pallets provide a stable base for a manufacturer or distributor of a product to stack items thereon allowing for ease of movement by use of a forklift or pallet jack. Pallets are constructed from wood, metal, or plastic, and designed to be placed under materials that are to be shipped or stored, providing a clearance underneath for placement of a forklift or pallet jack.

Pallets are reusable requiring that they be durable in construction, lightweight, and stackable. Ideally, the pallet should occupy a minimum amount of space, both vertically and horizontally. The durability of a pallet is dependent on the type of material used for construction. Pallets constructed of wood will provide years of service if not exposed to harsh conditions that could cause rotting, or unusual loading situations which could cause collapse of the wood frame or wood components. Wood pallets are in constant need of repair wherein a damaged pallet slat is replaced with a new slat by either nailing or stapling to the base frame. A problem with wooden pallets is that wood is a porous material. When used in the food industry, wood can harbor bacterial growth which may contaminate food products. Relatedly, insects and other pests can burrow into the wood and be transported into and infest a previously uncontaminated storage area. Such pests can continue to reproduce and thrive in the wooden structure of the pallet.

Additionally, the porosity of the wood allows for absorption of water. Should the pallet freeze, it can be easily cracked when loaded, even when supporting lightweight products. Should a pallet absorb water, the weight of the pallet can cause difficulties in moving the pallet, and/or injuries to an individual manually moving the pallet. Moreover, splintering from the wood requires an individual who handles the pallet to wear gloves, and otherwise take precautions to prevent from injuring himself during relocation of the pallet.

Wooden pallets also have a significant disadvantage in that they do not interlock or readily stack. Accordingly, should a number of wooden pallets be placed on top of each other, the possibility exists for the pallets to tip over. The is particularly true when any of the pallets within the stack slips away from a squarely stacked position above the underlying pallet.

An alternative to wooden pallets includes metal pallets, such as those formed by aluminum. Metal pallets are known for their durability under normal circumstances. However, aluminum pallets are expensive to manufacture and once damaged, cannot be readily repaired. Should any interim damage occur such as breach of a weldment, the pallet could have a catastrophic failure under a loaded condition. This could cause injury to operating personnel or damage to the materials positioned on the pallet.

Yet another material used for the construction of pallets is plastic. Plastic is capable of being sterilized, and is impervious to most environmental conditions. However, a plastic pallet is even more difficult to repair than metal. Should a portion of the pallet become damaged, the entire pallet is destroyed. The cost of such replacement makes the use of plastic pallets, as a direct replacement for wood pallets, cost prohibitive. Despite their superior strength over wood pallets, plastic pallets still cannot withstand unusually forceful abuse, such as when a forklift or semi-truck runs over a portion of the pallet. Such forces may cause the plastic pallet to crack, whereas a wood pallet may only need a section replaced.

Accordingly, what is lacking in the art is a lightweight, re-usable plastic pallet comprised of component parts that allow for modular construction and related ease of component replacement.

SUMMARY OF THE INVENTION

The present invention provides an interlocking modular pallet apparatus comprised of two molded plastic component parts which are mirror images of each other and made to interlock. Upon placing two mirror image parts together, and then joining these parts together with yet another joined mirror image pair, a modular section comprised of four parts is formed through the joinder of interlocking flanges formed along the intersecting borders of each part. In this manner a full sized pallet may be constructed from only two different component parts, thereby allowing for low cost manufacturing. Moreover, this arrangement necessitates only two molds for forming the component parts.

The first component part formed from a single mold employs a plurality of dove tailed flanges which extend downward along the inner border of the part. The second component part consists of diagonally mounted dove tail flanges which extend in a downward position and operably interlock with the downward extending flanges. Each component part has two interlocking flanges along each of the mating edges which secure to two interlocking dove tail flanges on the opposing component part. Together, the two joined sections form one half of a conventional sized pallet. Two more sections are joined together to form an second half of the pallet. The first and second halves are interlocked together to create a conventional sized pallet available for the loading and transportation of goods.

Each pallet section includes a platform area with a upper and lower surface. A plurality of legs extend downwardly from the bottom surface of each section to provide elevation of the platform. The elevation allows for insertion of a forklift, or a pallet jack under the platform sections. The legs include at least one tapered, or straight walled structure, under each corner of each modular section. The center-most corner of each section includes a quarter-portion of a cone, which when joined with the other platform sections forms a complete conical shape which serves as a center leg of the pallet. The conical shape may also be used to receive a ring of durable material such as steel which is forced down around the conical surface leg structure thereby locking the four adjoining sections tightly together.

A lip or tab section formed around the circumference of the conical central structured leg allows the ring to be securely retained in a fixed position thereby prohibiting movement of the ring by any means except a specially designed ring removal tool. While this interlocking pallet design does not necessitate the use of a ring, the ring does provide additional security to prevent disengagement of the interlocking flanges. Such extra securement may be beneficial in the prevention of accidents relating to improper forklift or pallet jack positioning in combination with improper pallet loading.

Each platform section includes adjacent square-shaped through holes. This grid-like arrangement provides a strong, yet lightweight construction with considerable savings of plastic material. Such through holes also allow for thorough cleaning of the form pallet structure, as water can easily pass through the holes. Relatedly, items placed on the pallet can be washed down. Leaks from pallet materials can also occur without bothersome and/or dangerous pooling of such liquids on the platform surface.

A problem with conventional plastic pallets is that the hard plastic used to form a plastic pallet is likely to have a surface with a low coefficient of friction as compared to wood. Hence, boxes and other items placed on a plastic pallet will be subject to sliding. Additionally, a forklift placed under the pallet will encounter this same low friction surface and therefore a pallet might easily slip off the blades of the lift if a downward angle is encountered. Accordingly, a set of rubber pads are provided which fit into the through holes of the platform sections. The upper surface of each pallet section includes two rubber pads positioned along the upper perimeter of the platform section. The pads thereby form a protective border against sliding materials placed on the upper surface of the pallet.

Correspondingly, a set of rubber pads is also included on the bottom surface of the platform sections, as positioned along the perimeter, and in between the leg structures. These rubber pads provide a frictional surface for engagement with the blades of a fork or pallet lift. The upper and lower pads include interlocking appendages or flanges arranged in line so as to interlock with each other when inserted into the through holes.

It is therefore an object of the present invention to provide a lightweight, durable pallet comprised of modular plastic parts which are interlockably connected to provide an elevated pallet platform surface.

It is another object of the present invention to provide a pallet comprised of four modular platform sections that are created from two individual molds and allowing the creation of a single pallet based upon joining together two modular components from one mold and two modular components from the second mold, the sections having interlocking flanges with dovetailed or butterfly shaped flanges on one section operably interlocking with corresponding flanges on the adjoining section.

It is still another object of the present invention to provide a pallet where the modular sections have a grid or lattice-like structure.

It is yet another object of the present invention to provide a pallet where each section includes at least three leg support structures and a center support structure extending from the bottom surfaces.

It is yet still another object of the present invention to provide a pallet where the center support structure of each platform section combines to form a conical shaped support structure which is receptive to a joining ring which fictionally fits over the conical support structure for tightly drawing and holding the platform sections together.

It is still another object of the present invention to provide frictional paths on the upper and lower surfaces on the pallet platform.

It is yet a related object of the present invention to provide frictional paths with interlocking flanges whereby the upper and lower paths are lined up and interlocked together through the platform lattice around the perimeter of the platform.

Still another object of the invention is to teach the use of legs have approximately 8 degree inclines which prohibits locking or binding of the pallets when placed in a stacked position.

It is yet still another object of the instant invention to provide a lightweight sterilizable pallet structure that is easily cleaned, sterilized, and has provisions for placement of a portion of the pallet should an individual section be damaged.

It is yet another object of the present invention to provide a method of constructing a pallet device.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
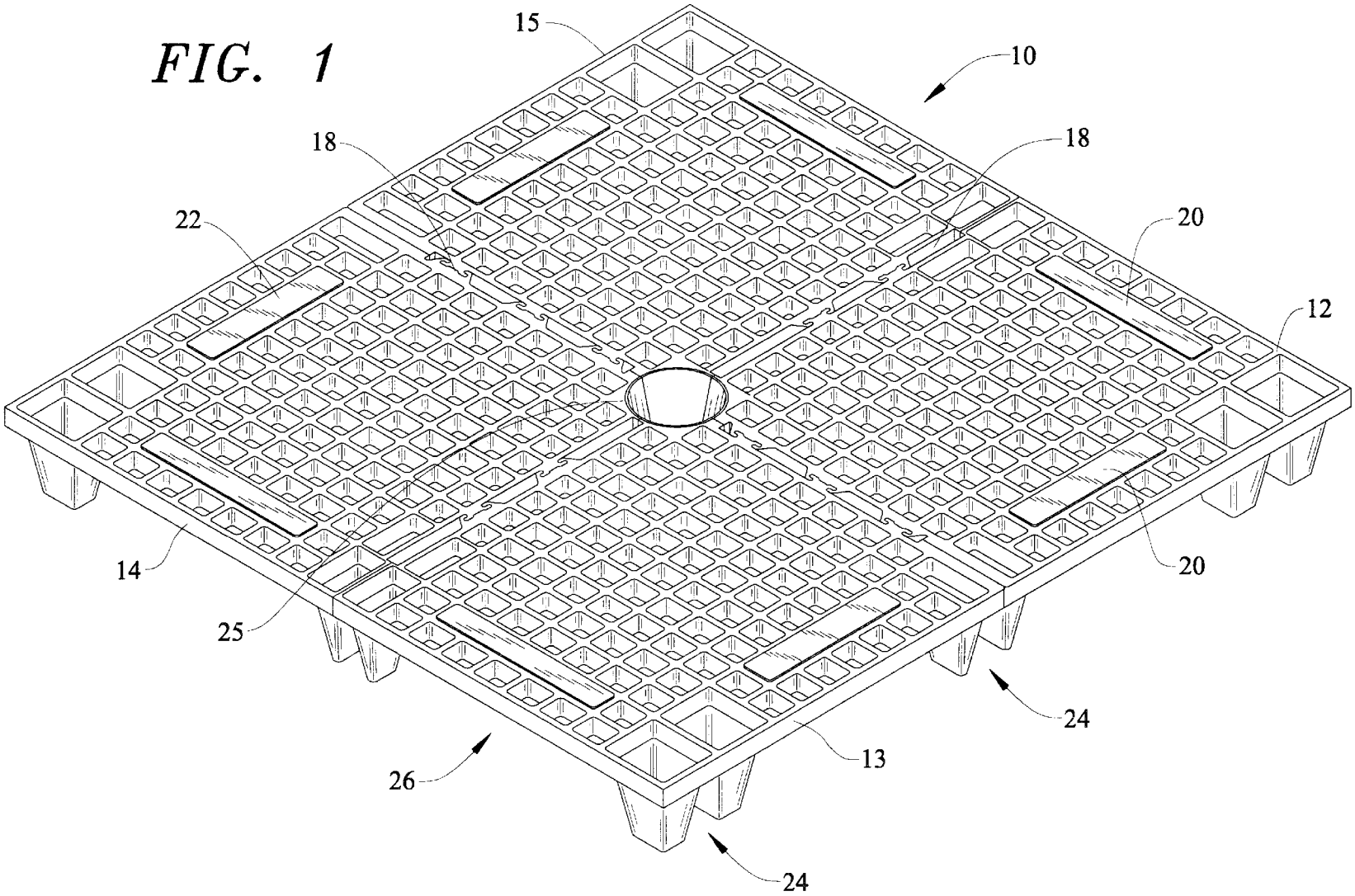
FIG. 1 is a top perspective view of a completed pallet device with the modular sections interlockably joined.
Figure 13:
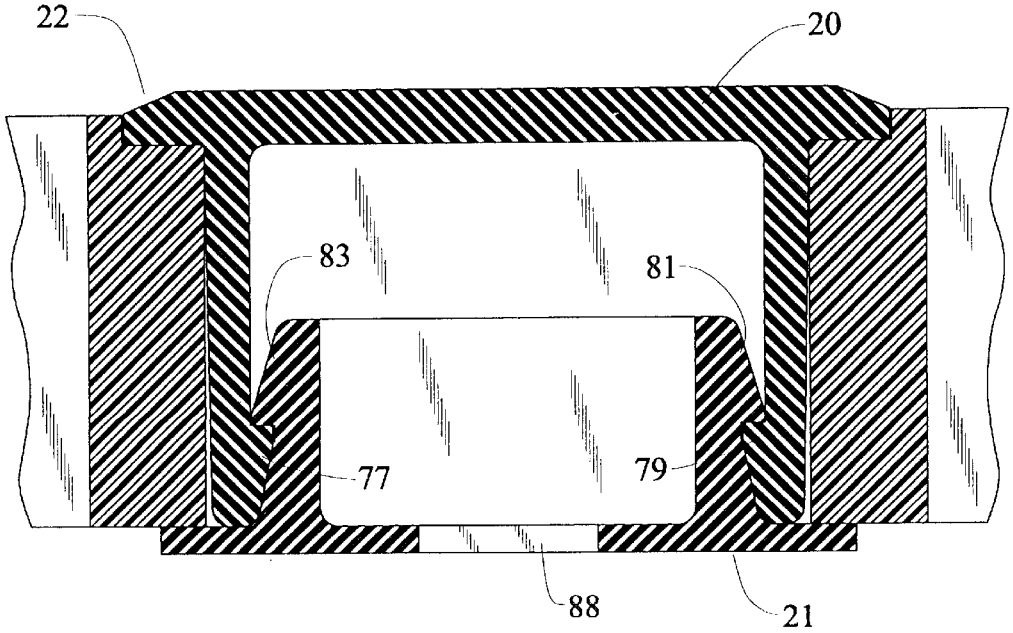
FIG. 13 is a side cutaway view of the upper and lower pads lockably joined together through a platform section.

Referring now to FIG. 1, a top perspective view of a complete pallet device 10 is shown which is comprised of a first 12, second 13, third 14, and fourth 15 modular sections. Each section 12–15 is interlockably joined to the next adjoining section along two sides by flanges 18 (See FIG. 4 below). Each section 12–15 is comprised of a grid-like or lattice structure of square-shaped through holes 22. A series of protective rubber pads 20 are placed through the lattice holes 22 around the perimeter of the completed pallet on the upper surface. Rubber pads 20 provide a frictional surface to prevent items from slipping off the completed pallet device 10. As shown in FIG. 13, described below, the upper surface pads 20 interlock with lower surface pads 21 through the lattice holes 22. The completed device 10 utilizes ten pairs of legs 24 and a central support structure 25 for elevating the platform 26 above the ground or floor.

Figure 2:
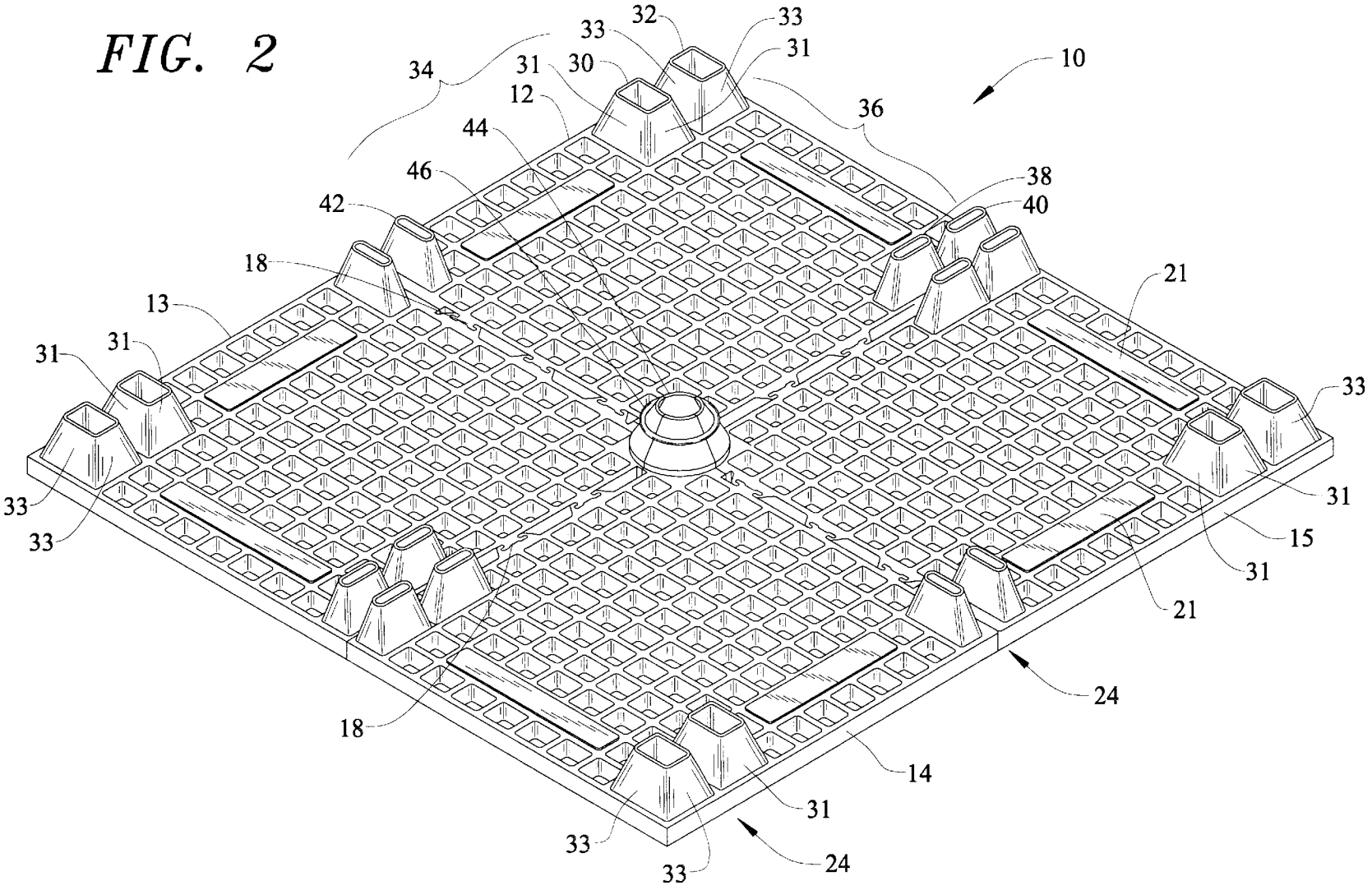
FIG. 2 is a bottom perspective view of a completed pallet device with the modular sections interlockably joined.

Referring now to FIG. 2, a bottom perspective view of the completed pallet device 10 of FIG. 1 is shown, with the modular sections 12–15 interlockably joined. The interlocking flanges 18 are slidably inserted from a vertical orientation allowing assembly by the placement of weight directly over the flanges to be interlocked. (See again FIG. 4). The paired legs 24 are shown distributed across the bottom surface of the pallet 10. Each modular section includes tapered leg structures 30, 32 of approximately 8 degrees extending downward from the outermost corner. Each modular section is rectangular in shape with long and short sides 34 and 36 respectively. The short side 36 includes a pair of leg structures 38,40. The leg structures 38,40 include ramped portions 31,33 that are sloped at approximately eight degrees from vertical. The leg structures 38,40 are also generally narrower in shape than leg structures 30, 32. The long side 34 includes a single tapered leg structure 42. The central corners of modular sections 12–15 each include a quarter-section of a central support structure 44. When the sections 12–15 are joined together, the completed structure 44 is conical in shape. A metal ring 46 is then placed over the conical structure and pushed downward to tightly draw together and hold the interlockably joined modular sections. The ring 46 is pushed over a lip or tab section (See FIG. 8) on the conical structure 44, locking the ring in place. The height of the pallet is approximately 4½ inches and when stacked on top of each other, the tapered leg insertion allows the stacked pallet to extend an overall height of approximately 6½ inches. Thus, each pallet added to a stack raises the height of the stack approximately 2 inches. It is noted that the 8 degree leg taper prevents the accidental locking of stacked pallets.

Figure 3:
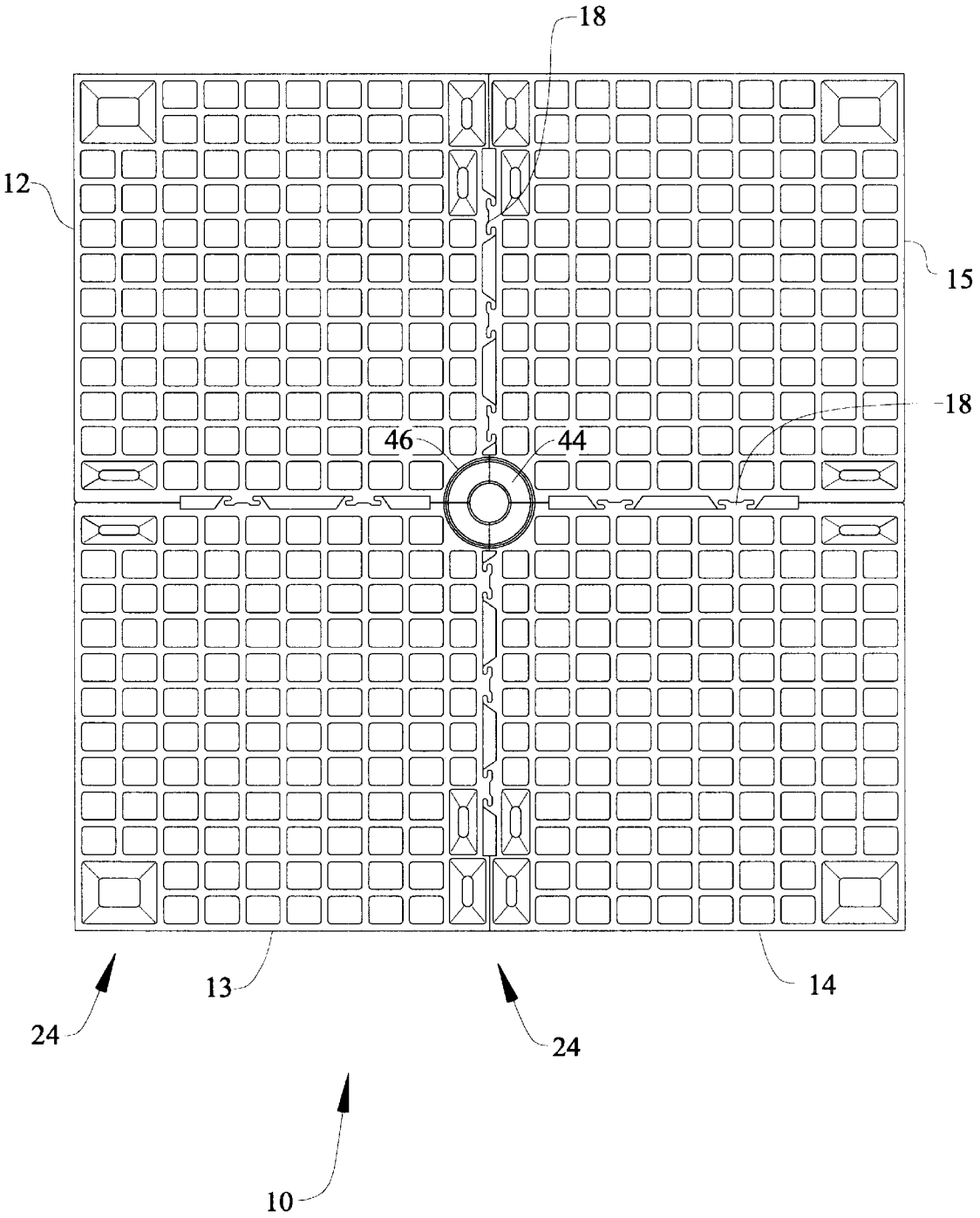
FIG. 3 is a top view of completed pallet device of FIG. 1.

Referring now to FIG. 3, a bottom view of the complete pallet device 10 is shown. The interlocking flanges 18 are shown interlocking the modular sections 12–15 together. The center support structure 44 is shown with the ring locked into place around the base of the cone. The paired legs 24 and center structure 44 are hollow in structure which saves material and weight without compromising strength.

Figure 4:
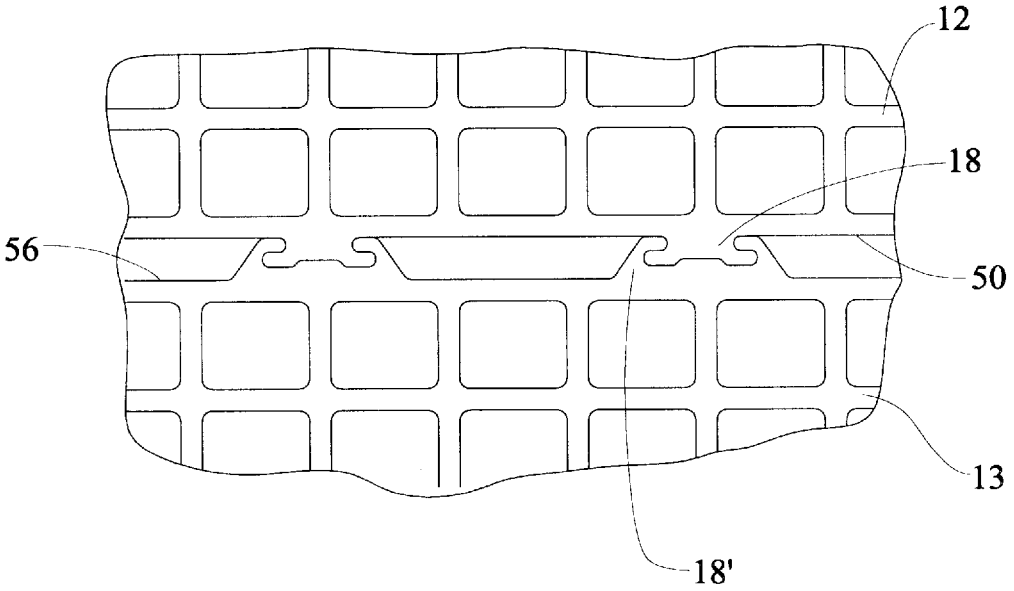
FIG. 4 is an enlarged view of the interlocking structure along 4—4 of FIG. 3.

Referring now to FIG. 4, a section of the interlocking surfaces between two modular sections 12 and 13 are shown, generally along cut 4—4 of FIG. 3. The dovetailed or butterfly-shaped flanges 18 are shown to extend out from the side surface 50 oriented along the upper and lower edges of the surface 50. A corresponding set of dovetailed or butterfly-shaped receiving flanges 18' extend out from the middle area of side surface 56. Flanges 18' provides a receptacle in a reverse fashion from flanges 18. Accordingly, the interlocking action that occurs between the flanges 18 and 18' when the surfaces 50 and 56 are brought together in a vertical compression fashion. While a dovetailed or butterfly shape is shown for the extending and receiving flanges, the invention is intended to include other flange shapes which would work equally as well to join the component parts together.

Figure 5:
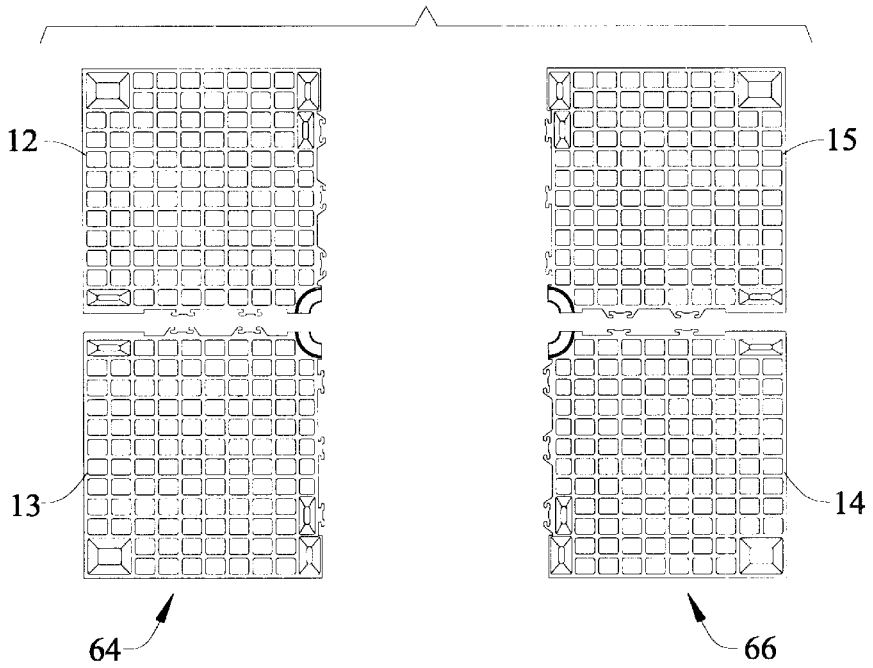
FIG. 5 illustrates a first pair and second pair of modular sections joined together.
Figure 6:
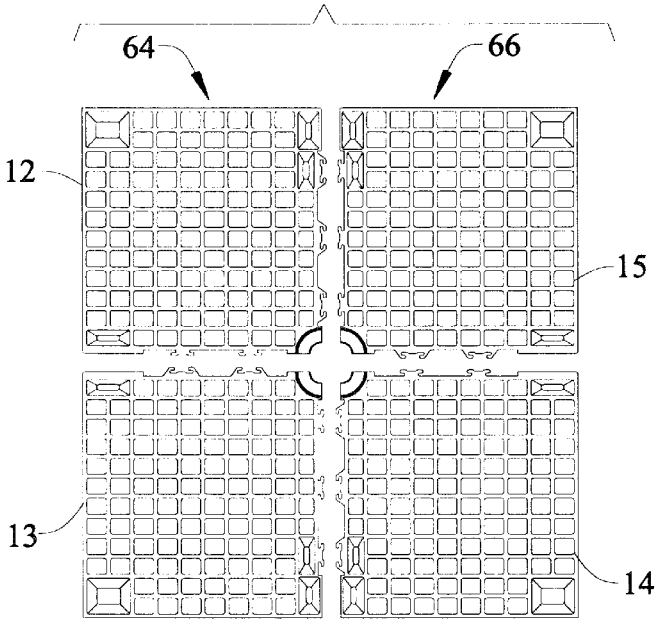
FIG. 6 illustrates the first and second pairs being joined into a complete pallet.

Referring now to FIG. 5, steps are shown which can be conveniently used to construct a completed pallet. The first two modular sections 12 and 13 are slidably joined together as shown by the arrows 60 and 62, via the locking flanges described above. In this manner, the modular section 12 is positioned on the ground with the flanges of modular section 13 aligned wherein pressure placed on modular section 13 results in the interlock. The interlock is frictionally engaged which prohibits disengagement without a similar applied pressure. Similarly, modular sections 14 and 15 are also joined together. The joined pairs 64 and 66 are then interlocked together as shown by arrows 68 and 70, via the interlocking flanges disposed therebetween.

Such construction, utilizing oblong or rectangular parts 12–15, forms a standard sized pallet as used in the industry. The present embodiment utilizes two molded identical parts 12 and 14, and 13 and 15, which can be readily interchanged. This allows the use of only two separate molds when forming pallet section parts. This invention also intends to encompass a square pallet, with identical square component sections having a standardized leg support pattern on each lower surface. Such identical component sections would allow the use of a single mold to form interchangeable modular sections.

Figure 7:
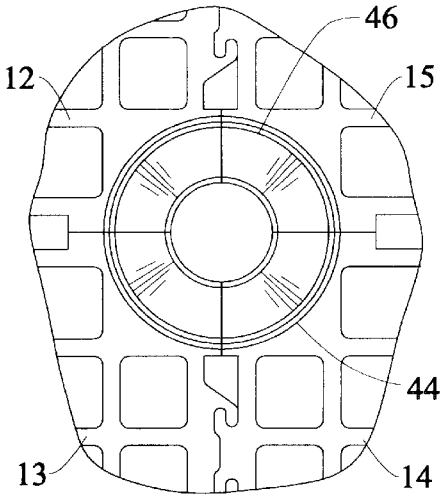
FIG. 7 is a partial top view of the center support structure with joining ring.
Figure 8:
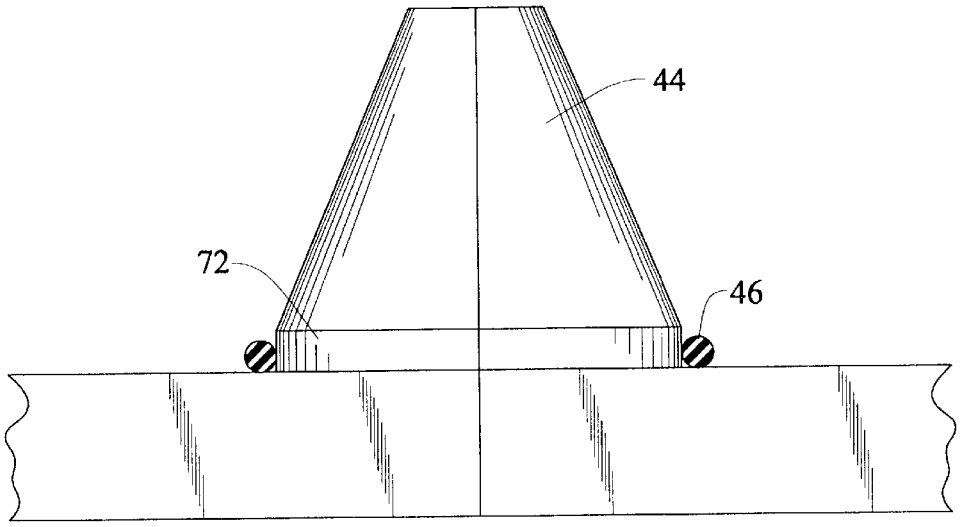
FIG. 8 is cutaway side view along cut 8—8 of the center support structure and ring of FIG. 7.

Referring now to FIG. 7, upon joinder of the parts 12–15, the central conical shape support structure 44 is formed. The ring 46 is placed over the conical section 44 thereby drawing the component parts 12–15 together. Referring also to FIG. 8, the ring 46 is forced down upon the expanding cone to interface with a lip or tab 72 around the base of the conical structure 44.

Figure 9:
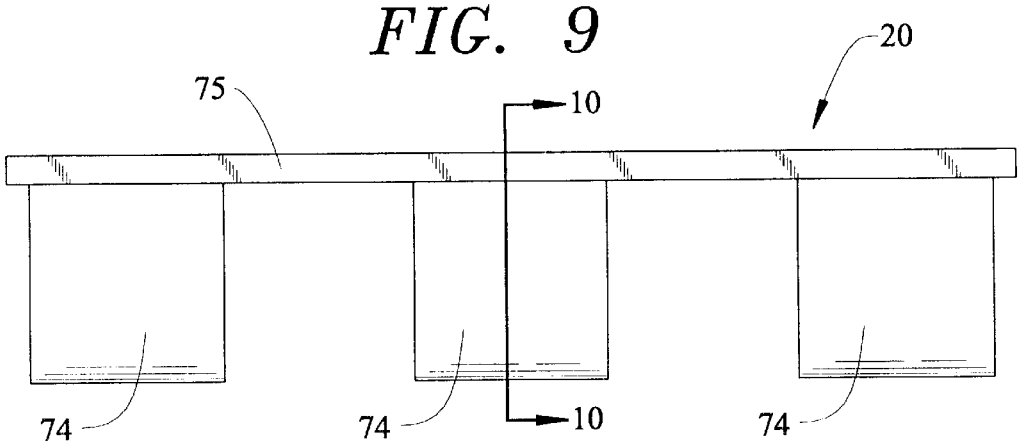
FIG. 9 is a side view of the upper rubber pad.
Figure 10:
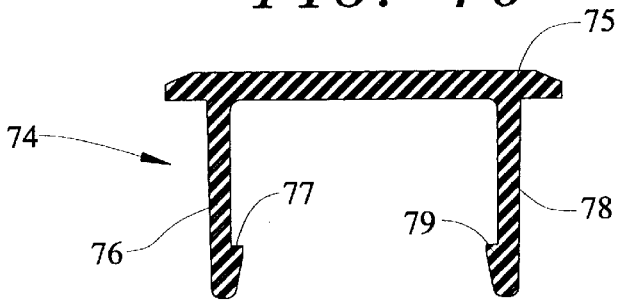
FIG. 10 is a cutaway view along cut 10—10 of the rubber pad of FIG. 9.

Referring now to FIG. 9, pad 20 is shown which fits over adjacent lattice holes 22 on the upper surface of the platform sections 12–15. The pad 20 has three square-shaped inserts 74 which are sized to fit into the holes 22 and extend down from an upper pad surface 75. The pad 20 is used to provide a frictional substance on the top of the pallet 10, and is therefore typically made from rubber or like materials. Referring also to FIG. 10, a cross sectional view of the pad 20 is shown along cut 10—10 of FIG. 9. The side surfaces 76 and 78 of the inserts 74 have inward facing barbs or hooks 77, 79 for interlocking with the bottom surface pad 21, described below.

Figure 11:
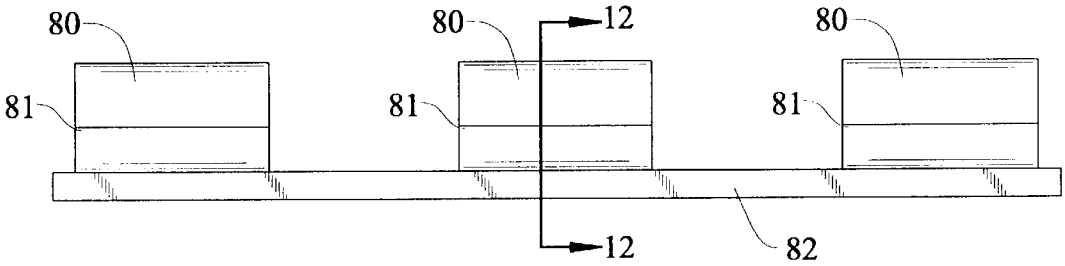
FIG. 11 is a side view of the lower rubber pad.
Figure 12:
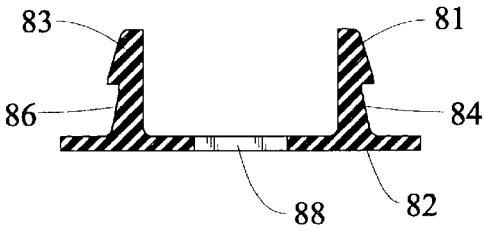
FIG. 12 is a cutaway view along cut 12—12 of the rubber pad of FIG. 11.

Referring now to FIG. 11, the bottom surface pad 21 is shown having three inserts 80 which extend from a pad surface 82. Pad 21, which attaches to the lower surface of the pallet, provides a frictional engagement surface for the blades of a lifting device. Inserts 80 are sized to fit inside inserts 74 above. Referring also to FIG. 12, a cross section view of the pad 21 is shown along cut 12—12 of FIG. 11. Each insert 80 has outwardly facing barbed or hooked surfaces 81 and 83 on each side surface 84 and 86. Each insert section also includes a through hole 88. The pads 20 and 21 might similarly include more or fewer inserts 74 and 80 depending upon the size pad needed to span more or fewer lattice holes 22.

Referring now to FIG. 13, a cross sectional view of the inserts 74 and 80 are shown as inserted through a lattice hole 22. Through such interlocking of the barbs or hooks 77 and 83, and the barbs or hooks 79 and 81, the pads 20 and 21 can be securely attached to each other through the lattice network of the pallet device, as further shown in FIGS. 1 and 2.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

What is claimed is:

1. A pallet device comprising:

a first modular component section and second adjoining modular component section, each of said modular component sections having a platform area with upper, lower and side surfaces;

a plurality of leg support structures extending from each of said lower surfaces;

interlocking flanges extending from opposing first and second said side surfaces of said adjoining sections, said flanges being defined as a plurality of butterfly shaped extensions having corresponding receptacles, said first side surface of each section having said butterfly shaped extensions, said opposing second side surface of each section including said receptacles, wherein said extensions and receptacles interlock with each other; and a center support structure selectively formed by cooperative engagement of adjacent said leg support structures of said component sections.

2. The pallet device of claim 1, including a band placed over said center support structure, wherein said band draws and locks together said component sections.

3. The pallet device of claim 1, wherein said modular component sections are made from plastic.

4. The pallet device of claim 1, wherein said pallet device is formed from four modular component sections interlockably joined in a two-by-two arrangement.

5. The pallet device of claim 1, wherein each said component section is interlockably joined to form an inner and outer corner and four pallet sides, said plurality of leg structures including a pair of tapered supports on each outer corner, and at least a pair of tapered supports along each pallet side, each said inner corner including a quarter of a conical structure which is formed upon joinder of said component sections via said flanges.

6. The pallet device of claim 5, wherein said tapered leg structures each have a ramped portion characterized by an approximately-eight-degree slope, whereby binding of pallets when nested is prevented.

7. The pallet device of claim 1, wherein said center support structure is conical in shape and includes a lip for lockably receiving a band which is in the form of a ring.

8. The pallet device of claim 7, including a metal band sized and shaped to selectively engage said lip.

9. The pallet device of claim 1, wherein said leg support structures and said center support structure are hollow in form.

10. A method of construction of said pallet device of claim 1, comprising the steps of:

aligning a first pair of said component sections along said flanged sides and slidably interlocking said flanges by moving said sections in opposing vertical directions;

aligning a second pair of said component sections along said flanged sides and slidably interlocking said flanges by moving said sections in opposing vertical directions;

aligning said first and second joined pairs along said flanged sides and slidably interlocking said flanges by moving said sections in a opposite vertical directions, this step completing said formation of said center support structure.

11. The method of construction of said pallet device of claim 10, including the step of placing a band over said center support structure and forcibly moving said band onto said structure to lock together said modular component sections.

12. A pallet device comprising:

a first modular component section and second adjoining modular component section, each of said modular component sections having a platform area with upper, lower and side surfaces, each of said platform areas comprising a lattice structure of through holes;

a plurality of leg support structures extending from each of said lower surfaces;

interlocking flanges extending from opposing first and second said side surfaces of said adjoining sections; and a center support structure selectively formed by cooperative engagement of adjacent said leg support structures of said component sections and;

an upper and lower pad, each pad having a plurality of inserts extending therefrom which are placed through said lattice structure holes, said upper and lower pads having interlocking hooked appendages, whereby said pads are aligned and interlocked onto said upper and lower surfaces of said platform sections.

13. The pallet device of claim 12, wherein said upper and lower pads are made from a rubberized material.

* * * * *